US008350764B2

(12) United States Patent
Rao et al.

(10) Patent No.: US 8,350,764 B2
(45) Date of Patent: Jan. 8, 2013

(54) LOW FREQUENCY DUAL-ANTENNA DIVERSITY SYSTEM

(75) Inventors: Qinjiang Rao, Waterloo (CA); Dong Wang, Waterloo (CA)

(73) Assignee: Research In Motion Limited, Waterloo, ON ( * ) Notice: Subject to any disclaimer, the term of this patent is extended or adjusted under 35 U.S.C. 154(b) by 353 days.

(21) Appl. No.: 12/797,599

(22) Filed: Jun. 9, 2010

(65) Prior Publication Data

US 2011/0298669 A1 Dec. 8, 2011

(30) Foreign Application Priority Data

Jun. 8, 2010 (EP) ..... 10165259

(51) Int. Cl.
*H01Q 1/24* (2006.01)

(52) U.S. Cl. ..... 343/702; 343/700 MS; 343/895

(58) Field of Classification Search ..... 343/702, 343/700 MS, 895

See application file for complete search history.

(56) References Cited

U.S. PATENT DOCUMENTS

| | | | | |
|---|---|---|---|---|
| 6,515,627 | B2 * | 2/2003 | Lopez et al. | 343/700 MS |
| 7,221,325 | B2 * | 5/2007 | Ide | 343/702 |
| 7,411,554 | B2 * | 8/2008 | Jung et al. | 343/700 MS |
| 2008/0129632 | A1 | 6/2008 | Moon | |
| 2009/0128425 | A1 | 5/2009 | Kim | |
| 2009/0256763 | A1 | 10/2009 | Chi et al. | |
| 2011/0215971 | A1 * | 9/2011 | Rao | 343/702 |

FOREIGN PATENT DOCUMENTS

| | | | |
|---|---|---|---|
| CA | 2644946 | A1 | 8/2007 |
| EP | 1944828 | A2 | 7/2008 |
| EP | 2028715 | A1 | 2/2009 |
| EP | 2034555 | A1 | 3/2009 |

OTHER PUBLICATIONS

Browne, David et al, Experiments with Compact Antenna Arrays for MIMO Radio Communications, IEEE Transactions on Antennas and Propagation, IEEE Service Center, Nov. 1, 2006.

European Search Report for EP Application No. EP 10165259.2, dated Nov. 16, 2010.

Kyro et al., "Dual-Element Antenna for DVB-H Terminal", 2008, Loughborough Antennas & Propagation Conference, Mar. 2008, Loughborough UK, pp. 265-268.

Rao et al., "Ultra-Small Cubic Folded Strip Antenna for Handset Devices", 2008 AP-S IEEE Antennas Propag Soc Int Symp,. San Diego, CA pp. 1-4.

Lopez et al., "Compact Metamaterial Antenna Array for Long Term Evolution (LTE) Handset Application", IWAT 2009, pp. 1-4.

"Device Requirements LTE 3GPP Band 13 Network Access Version 0.9", Verizon Wireless, Issued Apr. 2009, pp. 1-31.

(Continued)

*Primary Examiner* — Hoang V Nguyen
(74) *Attorney, Agent, or Firm* — Moffat & Co.

(57) ABSTRACT

A dual-antenna diversity antenna system that operates within a low frequency band range is disclosed. Two antennas are folded separately onto a single three dimensional dielectric substrate in a meander pattern configuration. Each antenna has an independent feed port and ground pin. The two antennas are configured within a compact mobile terminal to produce high isolation and low correlation at resonating frequencies within the 700 Megahertz frequency band.

17 Claims, 14 Drawing Sheets

OTHER PUBLICATIONS

Pacaud, "Design and Analysis of Handset MIMO Antenna by Using Folded Monopole Antennas", 2008, Department of Electrical & Electronic Engineering, Mirishita Lab., National Defense Academy, Yokosuka Japan, pp. 1-94.

Geyi et al., "Handset antenna design: Practice and Theory", Progress in Electromagnetics Research PIER 80, 2008, pp. 123-160.

Wang et al., "Patch Loaded Tri-Monopole Wideband Antenna for Mobile Applications", 2009, IEEE International Conference on Ultra-Wideband, pp. 1-3.

International Search Report and Written Opinion for PCT/CA2011/050349, mailed Aug. 19, 2011.

* cited by examiner

LOW FREQUENCY DUAL-ANTENNA DIVERSITY SYSTEM

The subject application claims Paris Convention priority under 35 U.S.C. 119(a)-(d) of European Patent Application No. 10165259.2 filed on Jun. 8, 2010, the entire content of which is herein incorporated by reference.

BACKGROUND

1. Technical Field

This disclosure relates to an antenna diversity arrangement for a mobile terminal, and more specifically to the design and implementation of a three-dimensional dual-antenna diversity system that operates within a fundamental resonant low frequency band of 700 Megahertz (MHz).

2. Description of the Related Art

The design and implementation of multiple antennas in compact mobile terminals for low frequency applications present significant challenges in the achievement of high isolation between the antenna elements, low correlation, and increased diversity. Antenna designs for low frequency antenna applications may frequently include the implementation of additional matching circuits to reduce coupling. Metamaterial structures such as, without limitation, electromagnetic bandgap materials, may also be used to implement antenna elements in low frequency applications to reduce coupling and correlation.

In the low frequency bands, particularly the low frequency spectrum of the Long Term Evolution technology, such as 746-787 MHz frequency bands, it is typically challenging to achieve low correlation and high isolation in mobile terminals of compact size and limited internal space for the antenna elements and other components.

BRIEF DESCRIPTION OF THE DRAWINGS

For a better understanding of the disclosure and the various embodiments described herein, reference is now made to the following brief description, taken in connection with the accompanying drawings and detailed description, which show at least one exemplary embodiment.

DETAILED DESCRIPTION

Figure 1A:
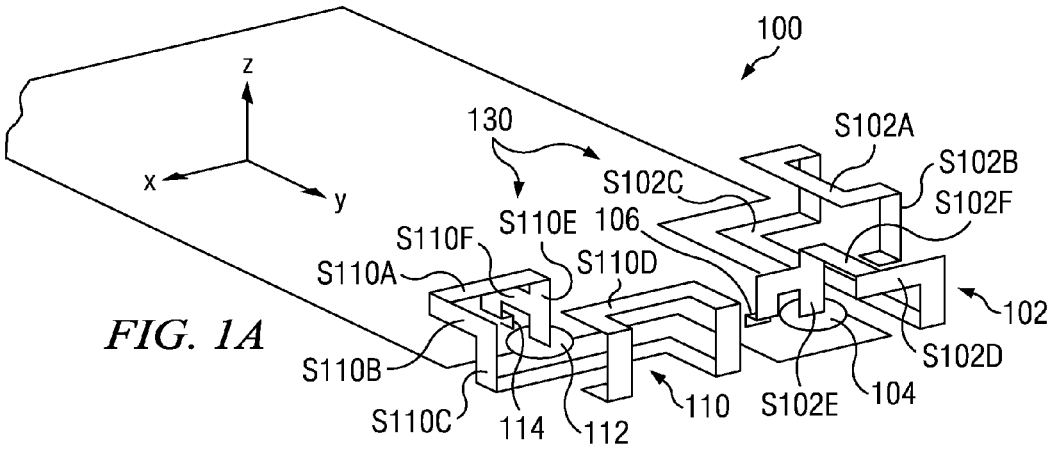
FIG. 1 illustrates a planar view of a dual-antenna diversity arrangement in FIG. 1A, FIG. 1B, and FIG. 1C in accordance with an illustrative embodiment of the disclosure.

It should be understood at the outset that although an illustrative implementation of one or more embodiments are provided below, the description is not to be considered as limiting the scope of the embodiments described herein. The disclosure may be implemented using any number of techniques, whether currently known or in existence. The disclosure should in no way be limited to the illustrative implementations, drawings, and techniques illustrated and described herein, which may be modified within the scope of the appended claims along with a full scope of equivalence. It should be appreciated that for simplicity and clarity of illustration, where considered appropriate, the reference numerals may be repeated among the figures to indicate corresponding or analogous elements.

According to an illustrative embodiment, a mobile communications device comprises dual-antennas. Each antenna comprises a plurality of conductive strip segments electrically connected together and configured into a meander pattern. The first antenna of the dual-antennas is disposed at a first corner of a single three-dimensional dielectric substrate and comprises a first feed port and a first ground pin. A second antenna of the dual-antennas includes conductive strip segments configured in a meander pattern that is identical to the first antenna and is disposed at a second corner of the single three-dimensional dielectric substrate that is opposite the first corner and comprises a second feed port and a second ground pin. The second antenna is configured in a meander pattern that is the same as the first antenna.

In accordance with another embodiment of the disclosure, an antenna arrangement for a mobile communication device comprises dual-antennas, each antenna comprising a plurality of conductive strip segments electrically connected together and configured into a meander pattern. A first antenna of the dual-antennas is disposed at a first corner of a single three-dimensional dielectric substrate; and comprises a first feed port and a first ground pin. A second antenna of the dual-antennas includes conductive strip segments configured in the meander pattern that is identical to the first antenna and is disposed at a second corner of the single planar dielectric substrate that is opposite the first corner. The first antenna and the second antenna comprise a separate feed port and a separate ground pin.

The present disclosure provides a mobile communication device that comprises dual-antennas arranged on a single three-dimensional dielectric substrate. Each antenna comprises a plurality of conductive strip segments that are connected together and disposed on the dielectric substrate in a meander pattern. The conductive strip segments are folded in a three-dimensional pattern onto the dielectric substrate.

Each antenna has a separate feeding port and separate connection to a ground plane. The spatial distance between the dual-antennas is approximately 30 millimeters (mm) in a mobile device of an exemplary size such as 105 mm by 58 mm. Additionally, in the dual-antenna arrangement, each antenna may be placed orthogonally or symmetrically with respect to the other antenna element. The orthogonal and symmetrical arrangements of the dual-antennas enable polarization and pattern diversity.

In this disclosure, FIG. 1 through FIG. 3 illustrates different design arrangement embodiments of a dual-antenna system. An antenna in embodiment may be positioned or oriented differently with respect to the x-axis and the other antenna in the arrangement. The antenna in the design arrangements of FIG. 1 through FIG. 3 may include, but is in no way limited to, planar inverted F antenna (PIFA), an inverted antenna (IFA), a type of monopole antenna, or other such antenna elements known to one skilled in the art.

Figure 1B:
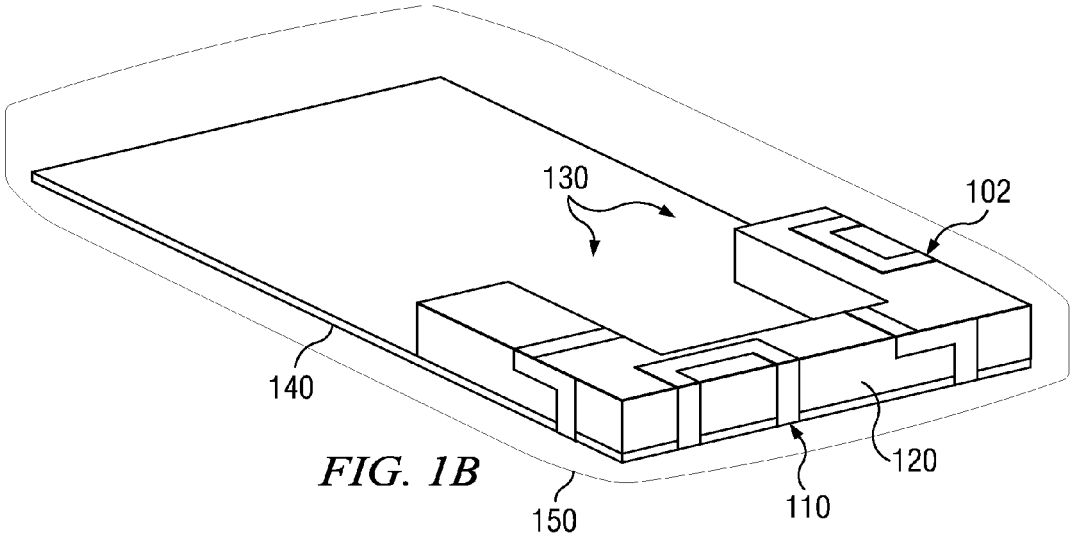
Figure 1C:
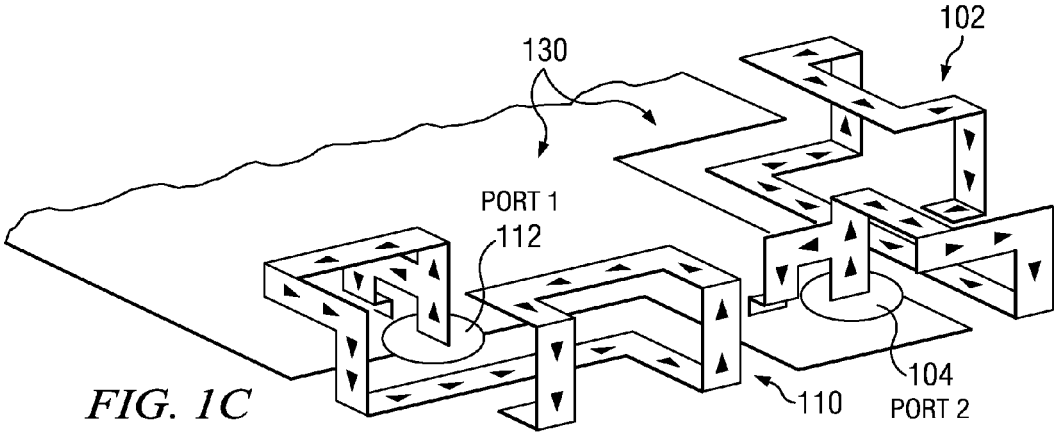

Turning first to FIG. 1, a planar view 100 of a dual-antenna diversity arrangement is depicted in FIG. 1A, FIG. 1B, and FIG. 1C in accordance with an illustrative embodiment of the disclosure.

FIG. 1A illustrates dual-antenna arrangement 130 comprising a first three-dimensional antenna 102 and a second three-dimensional antenna 110. Three-dimensional antenna 102 may be comprised of a plurality of conductive strip segments that are connected together in a meander pattern. For example, the conductive strip segments may include, without limitation, segments S102A, S102B, S102C, S102D, S102E, and S102F. Similarly, three-dimensional antenna 110 may be comprised of a plurality of segments such as, without limitation, S110A, S110B, S110C, S110D, S110E, and S110F.

Each three-dimensional antenna in the dual-antenna diversity arrangement is connected to a separate feed port and a separate ground. For example, three-dimensional antenna 102 includes a feed port 104 connection and a ground pin 106 connection. Similarly, three-dimensional antenna 110 includes a single feed port 112 connection and a single ground pin 114 connection. Three-dimensional antenna 110 is oriented orthogonally or rotated ninety-degrees with respect to the position of three-dimensional antenna 102.

Turning now to FIG. 1B, dual-antenna arrangement 130 is depicted as being mounted or attached to substrate 120. Three-dimensional antenna 102 and three-dimensional antenna 110 are folded onto substrate 120 in a meander pattern through the connection of a plurality of conductive strip segments laid out for each respective three-dimensional antenna. In the illustrative embodiment, dual-antenna diversity arrangement 130 may be positioned in a housing 150 for a mobile device. As referenced in FIG. 1A, three-dimensional antennas 102 and 110 include separate feed ports (not shown) and ground connections (not shown) to ground plane 140. The strip segments may be connected through soldering strip segments together or through folding or bending of strip segments.

The dielectric substrate 120 may be formed from a material that includes, but is in no way limited to, air, fiberglass, plastic, and ceramic. In an illustrative embodiment, ground plane 140 may be located parallel to and attached to an opposite side of dielectric substrate 120. In yet another embodiment, ground plane 140 may be disposed at a certain height from dielectric substrate 120.

Dielectric substrate 120 may be three-dimensional in configuration and have the shape of a polygon. In a preferred embodiment, the polygonal-shaped dielectric substrate may be rectangular. In another embodiment, the polygonal-shaped substrate may be square. Various configurations of the dielectric substrate are possible as would be recognized by one skilled in the art.

Referring to FIG. 1C, an exemplary current distribution of dual-antenna arrangement 130 at a specific point in time is illustrated. The current distribution of dual-antenna arrangement 130 depicts two separate current flows along the direction of the strip segments. For example, first antenna 102 is positioned at a first edge of the dielectric substrate, such as dielectric 120 of FIG. 1B. Feed port 2 104 enables a current flow to be induced and distributed along the direction of the connected strip segments of first antenna 102 in horizontal and vertical directions according to the meander pattern of first antenna 102.

Second antenna 110 is rotated ninety degrees with respect to first antenna 102 in a clockwise direction and positioned at a second edge of the dielectric substrate 120 opposite the first edge. Feed port 1 112 enables a current flow to be induced and distributed along the interconnecting strips of second antenna 110 in horizontal and vertical directions according to the meander pattern of second antenna 110. The orientation of first antenna 102 and second antenna 110 results in pattern diversity. First antenna 102 and second antenna 110 are only approximately one-quarter lambda, $\lambda/4$, in length. Therefore, current only flows in one direction along the strip segments of the first antenna 102 and the second antenna 110 since currents only reverses direction after traveling a distance of $\lambda/2$.

Figure 2A:
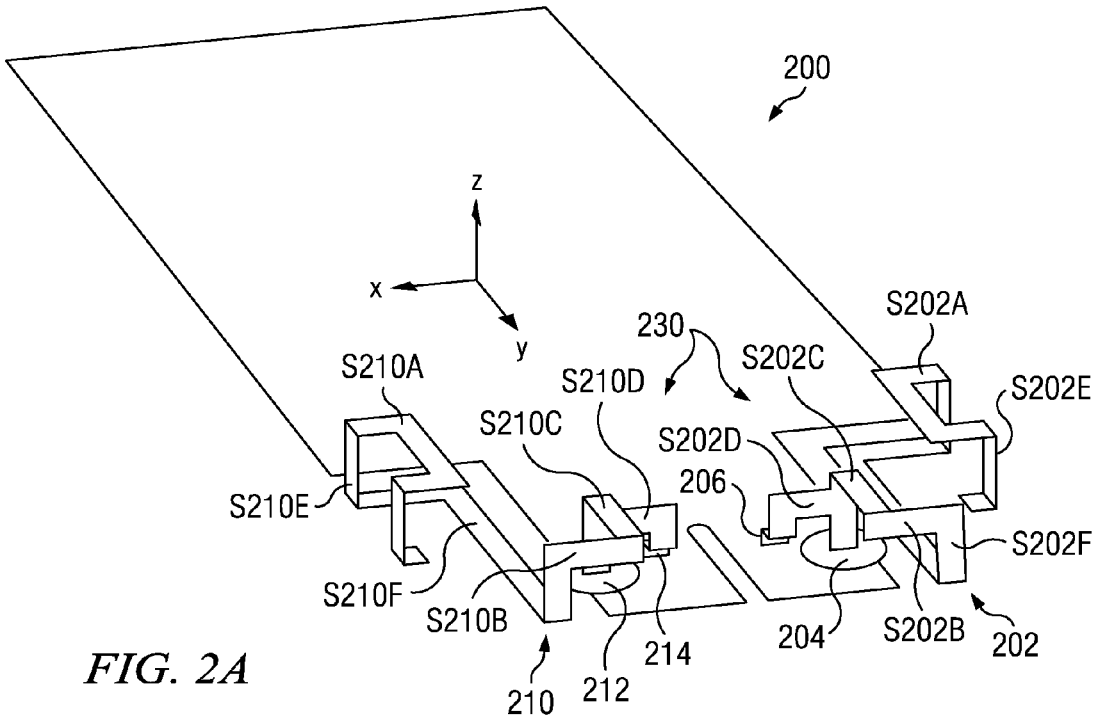
FIG. 2 illustrates a planar view of a dual-antenna diversity arrangement in FIG. 2A, FIG. 2B, and FIG. 2C in accordance with an illustrative embodiment of the disclosure.
Figure 2B:
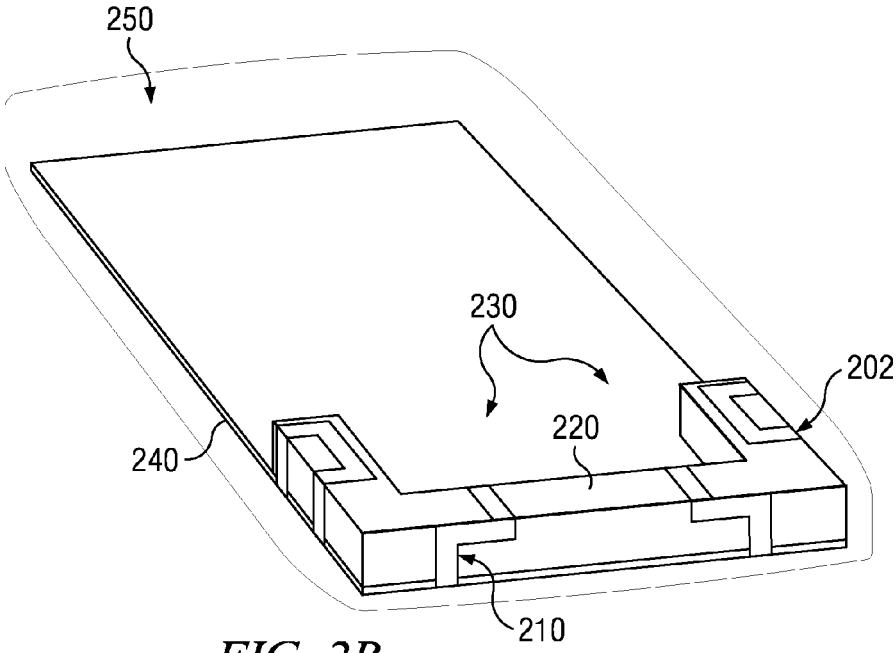
Figure 2C:
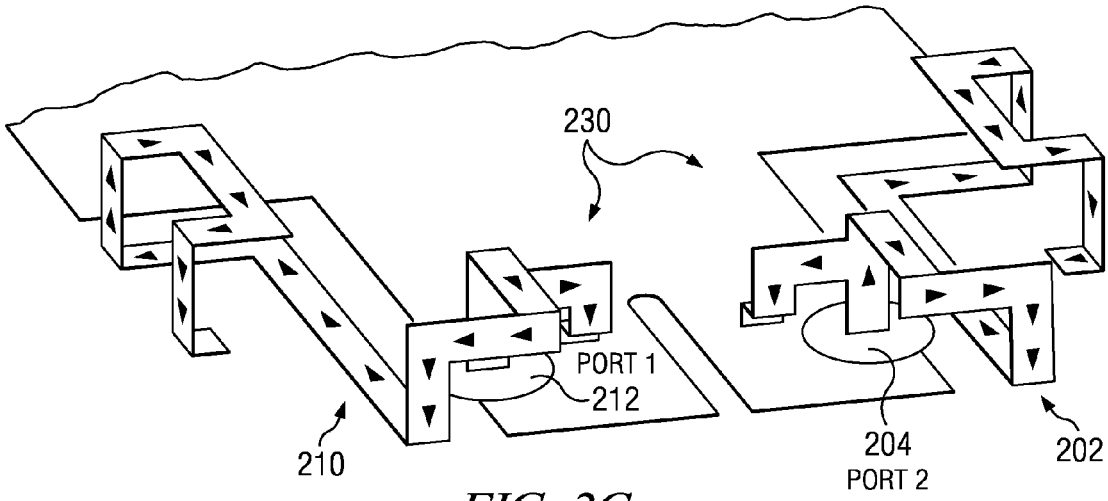

Turning now to FIG. 2, a planar view 200 of a dual-antenna diversity arrangement is depicted in FIG. 2A, FIG. 2B, and FIG. 2C in accordance with an illustrative embodiment of the disclosure.

FIG. 2A illustrates a balanced dual-antenna arrangement 230 that includes a first three-dimensional antenna 202 and a second three-dimensional antenna 210 positioned at opposite edges of a dielectric substrate (not shown). Second three-dimensional antenna 210 is a mirror image of the first three-dimensional antenna 202 that is rotated clockwise 180 degrees about the axis of the first three-dimensional antenna 202.

FIG. 2A comprises a first three-dimensional antenna 202 and a second three-dimensional antenna 210. Similar to FIG. 1A, three-dimensional antenna 202 may be comprised of a plurality of conductive strip segments that are connected together in a meander pattern. For example, the conductive strip segments may include, without limitation, segments S202A, S202B, S202C, S202D, S202E, and S202F.

Similarly, three-dimensional antenna 210 may be comprised of a plurality of segments such as, without limitation, S210A, S210B, S210C, S210D, S210E, and S210F. First antenna 202 and second antenna 210 are each connected to separate feed ports and separate ground pins. First three-dimensional antenna 202 connects to feed port 204 and ground pin 206. Second three-dimensional antenna 210 connects to feed port 212 and ground pin 214. Three-dimensional antenna 210 is oriented orthogonally or rotated in a ninety-degree orientation with respect to the position of three-dimensional antenna 202.

Turning now to FIG. 2B, dual-antenna arrangement 230 mounted to substrate 220 is illustrated. Similar to FIG. 2A, three-dimensional antenna 202 and three-dimensional antenna 210 are folded onto substrate 220 in a meander pattern through the connection of a plurality of conductive segment strips laid out for each respective three-dimensional antenna. In the illustrative embodiment, the dual-antenna arrangement 230 may be positioned in a housing 250 for a mobile device. Three-dimensional antennas 202 and 210 include separate feed ports (not shown) and ground connections (not shown) to ground plane 240.

FIG. 2C illustrates an exemplary current distribution of dual-antenna arrangement 230 at a specific point in time. Similar to the current distribution illustrated in FIG. 1C, the current distribution of dual-antenna arrangement 230 depicts two separate current flows. For example, first three-dimensional antenna 202 is positioned at a first edge of a dielectric substrate (not shown), such as dielectric substrate 220 of FIG. 2B. Feed port 2 204 enables a current flow to be induced and distributed along the interconnecting strip segments of first three-dimensional antenna 202 in horizontal and vertical directions according to the meander pattern of first three-dimensional antenna 202.

Second three-dimensional antenna 210 is disposed in a mirror symmetry arrangement with respect to first three-dimensional antenna 202 and positioned at a second edge of the dielectric substrate 220 opposite the first edge. Feed port 1 212 enables a current flow to be induced and distributed along the interconnecting strip segments of second three-dimensional antenna 210 in horizontal and vertical directions according to the meander pattern of second three-dimensional antenna 210.

The orientation of first three-dimensional antenna 202 and second three-dimensional antenna 210 results in pattern diversity. First three-dimensional antenna 202 and second three-dimensional antenna 210 are only approximately one-quarter lambda, $\lambda/4$, in length. Therefore, current only flows in one direction along the strip segments of the first three-dimensional antenna 202 and the second three-dimensional antenna 210 since current only reverses direction after traveling a distance of $\lambda/2$. Current only reverses direction after traveling a distance of $\lambda/2$.

Figure 3A:
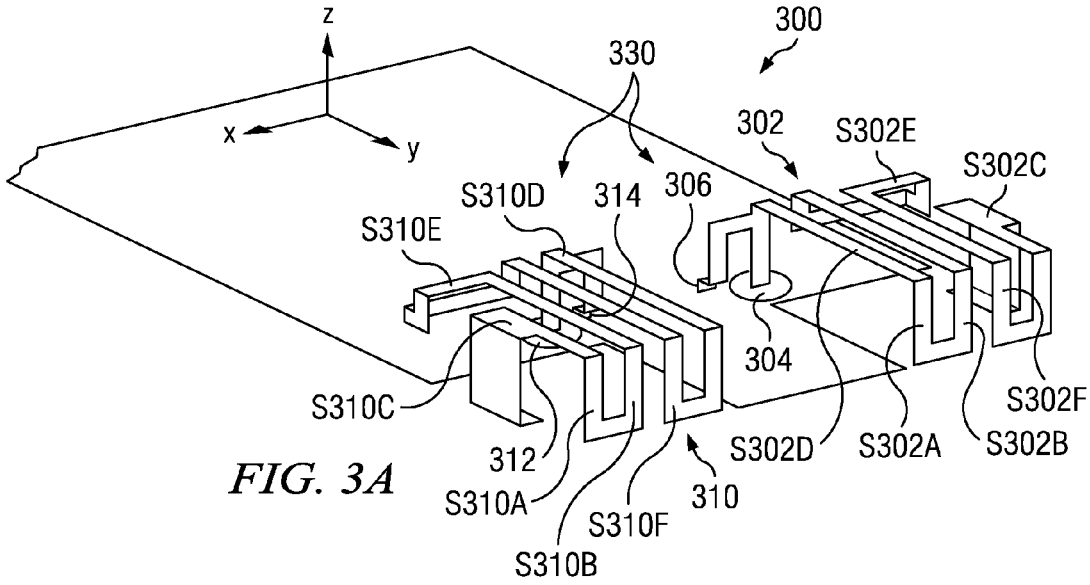
FIG. 3 illustrates a planar view of a dual-antenna diversity arrangement in FIG. 3A, FIG. 3B, and FIG. 3C in accordance with an illustrative embodiment of the disclosure.
Figure 3B:
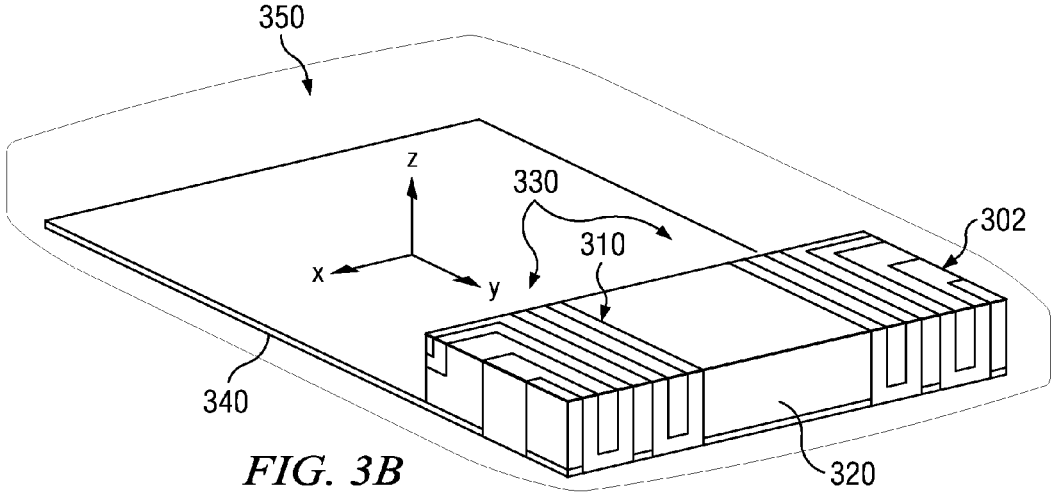
Figure 3C:
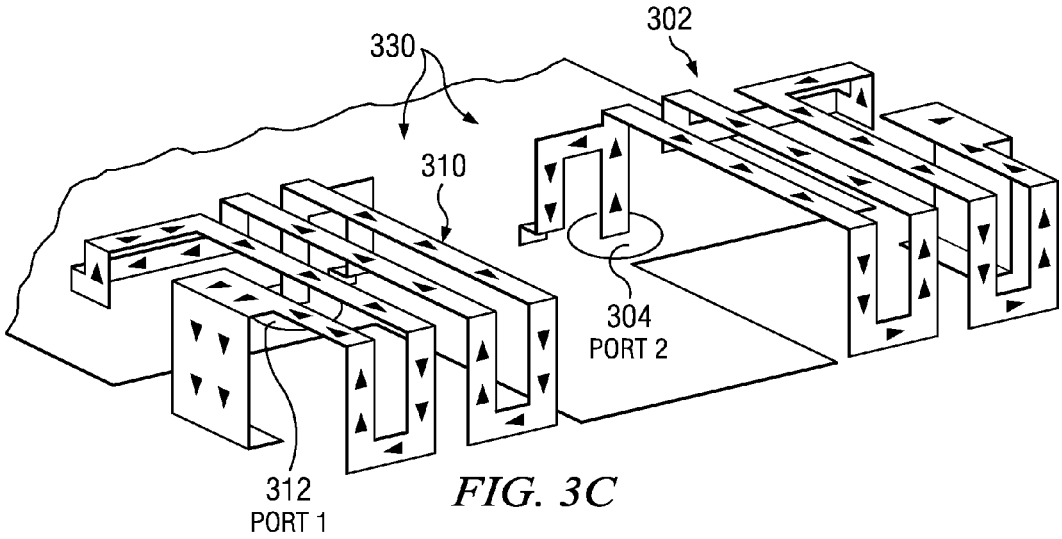

Referring now to FIG. 3, a planar view 300 of a dual-antenna diversity arrangement is depicted in FIG. 3A, FIG. 3B, and FIG. 3C in accordance with an illustrative embodiment of the disclosure.

FIG. 3A illustrates dual-antenna arrangement 330 comprising a first three-dimensional antenna 302 and a second three-dimensional antenna 310. Three-dimensional antenna 302 and three-dimensional antenna 310 are each comprised of a plurality of conductive strip segments that are connected together in a meander pattern. Three-dimensional antenna 302 is positioned on a first edge of a dielectric substrate (not shown) and three-dimensional antenna 310 is positioned on a second edge of the dielectric substrate that is opposite to and parallel to the first edge. Three-dimensional antenna 310 is disposed in a non-rotated, non-mirror orientation with respect to three-dimensional antenna 302.

For example, the conductive strip segments may include, without limitation, segments S302A, S302B, S302C, S302D, S302E, and S302F. Similarly, three-dimensional antenna 310 may be comprised of a plurality of segments such as, without limitation, S310A, S310B, S310C, S310D, S310E, and S310F. Each three-dimensional antenna in the dual-antenna diversity arrangement is connected to a separate feed port and a separate ground pin.

For example, three-dimensional antenna 302 includes a feed port 304 connection and a ground pin 306 connection. Similarly, three-dimensional antenna 310 includes a single feed port 312 connection and a single ground pin 314 connection. Three-dimensional antenna 310 is oriented orthogonally or rotated ninety-degrees with respect to the position of three-dimensional antenna 302.

Turning now to FIG. 3B, an illustration of dual-antenna arrangement 330 is depicted as being mounted or attached to substrate 320. Three-dimensional antenna 302 and three-dimensional antenna 310 are folded onto substrate 320 in a meander pattern through the connection of a plurality of conductive segment strips laid out for each respective three-dimensional antenna. In the illustrative embodiment, the dual-antenna arrangement 330 may be positioned in a housing 350 for a mobile device. Three-dimensional antennas 302 and 310 include separate feed ports (not shown) and ground connections (not shown) to ground plane 340.

Turning now to FIG. 3C, an exemplary current distribution of dual-antenna arrangement 330 at a specific point in time is illustrated. The current distribution of dual-antenna arrangement 330 depicts two separate current flows through two separate antennas. For example, first antenna 302 is positioned at a first edge of a dielectric substrate (not shown), such as dielectric substrate 320 of FIG. 3B. Second antenna 310 is positioned at a second edge that is opposite the first edge of the dielectric substrate.

Feed port 2 304 enables a current flow to be induced and distributed along the interconnecting strips of first three-dimensional antenna 302 in horizontal and vertical directions according to the meander pattern of first three-dimensional antenna 302. Current only flows in one direction on first three-dimensional antenna 302 since first three-dimensional antenna 302 is only approximately one-quarter lambda, $\lambda/4$, in length. Current only reverses direction after traveling a distance of $\lambda/2$.

Similarly, feed port 1 312 enables a current flow to be induced and distributed along the interconnecting strip segments of second three-dimensional antenna 310 in horizontal and vertical directions according to the meander pattern of the second three-dimensional antenna 310.

In illustrative embodiments of the dual-antenna arrangement of FIG. 1-FIG. 3, a first antenna may be configured as a transceiver that is operable to receive and transmit radio frequency signals. A second antenna may be configured as a receiver operable to receive radio frequency signals. Each antenna of the dual-antenna arrangement may operate simultaneously, or substantially at the same time, or separately, depending on implementation. The layout of each antenna of the dual-antenna arrangement is designed to enable polarization diversity and reduce coupling between the antennas during operation.

The illustrations of dual-antenna arrangements of FIG. 1-FIG. 3 is not meant to imply physical or architectural limitations to the manner in which different advantageous embodiments may be implemented. For example, the antenna may be located in different positions on the dielectric substrate and different locations in order to achieve a desired pattern diversity and polarization diversity.

Figure 4:
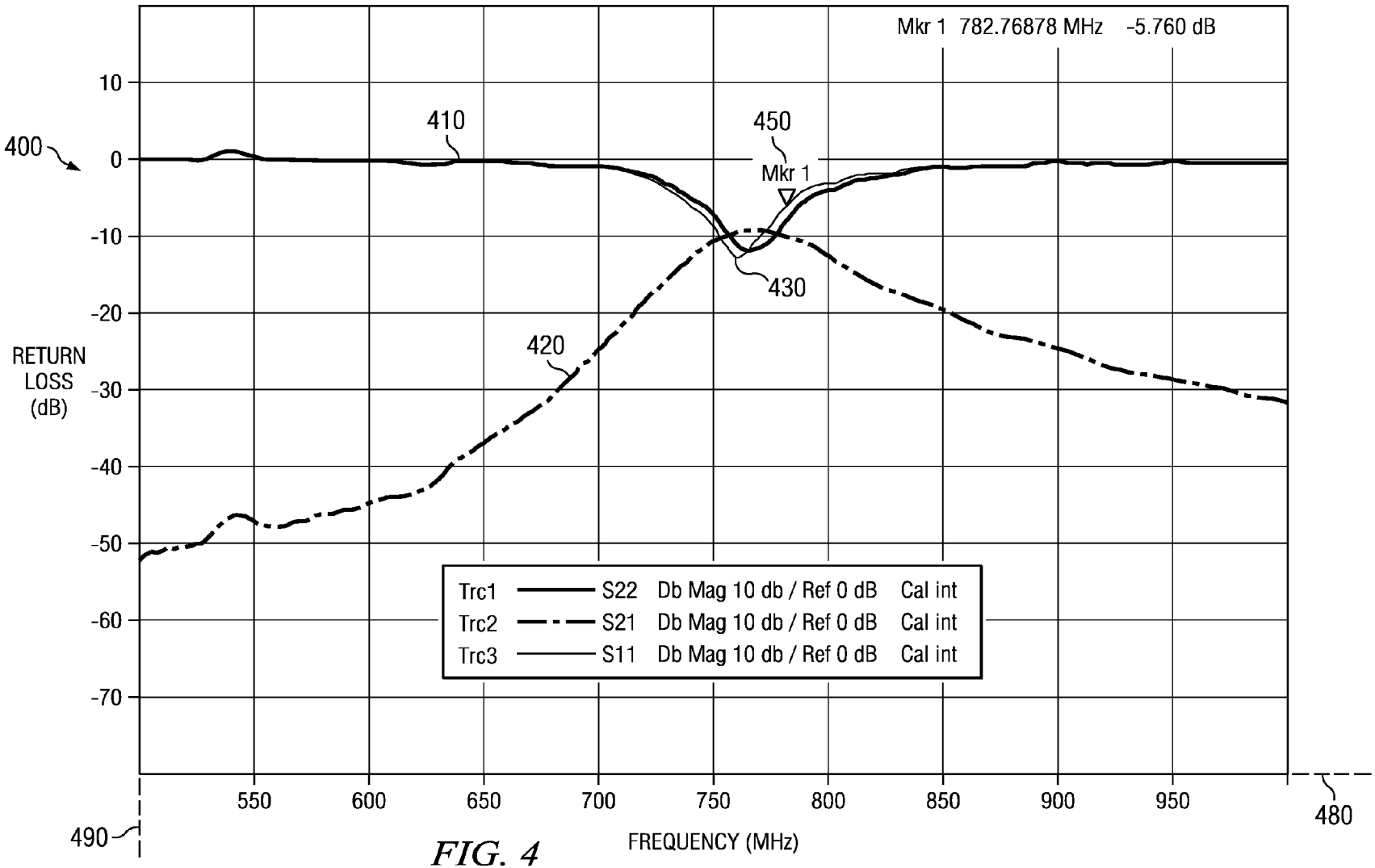
FIG. 4 illustrates a plot of measured return loss at selected operating frequencies of the low frequency bands of the Long Term Evolution technology for the dual-antenna diversity arrangement illustrated in FIG. 1 according to an embodiment of the disclosure.

Referring now to FIG. 4, a plot of measured return loss at selected operating frequencies of the low frequency bands of the Long Term Evolution (LTE) technology for the dual-antenna diversity arrangement as illustrated in FIG. 2 according to an embodiment of the disclosure.

In the depicted example, display 400 is an example of the return loss measured from feed ports of first antenna 102 and second antenna 110 in antenna arrangement 100 in FIG. 1. It must be noted that display 400 provides measurements based on an actual antenna system environment, and not based on a simulated or free space environment.

Return loss is the ratio of reflected power to incident power as measured at the feed port of an antenna. Return loss is expressed in decibels. The X-axis 480 of measured return loss plot 402 provides the frequency of a radio signal in Megahertz. The Y-axis 490 expresses in decibels (dB) the ratio of reflected and incident signals to a port. In this illustrative embodiment, an antenna arrangement, such as antenna arrangement 100 of FIG. 1, is configured to operate in a 700 MHz band range between frequencies of approximately 746 MHz to 787 MHz.

As illustrated, display 400 of port network analyzer illustrates traces of three different signals. Signal trace 1, Trc1 410, illustrates the return loss measured at feed port 2 104 of first antenna 102. Signal trace 3, Trc3 430 illustrates the return loss measured at feed port 1 112 of second antenna 110. Signal trace 2, Trc2 420, tracks the isolation measured between first antenna 102 and second antenna 110 as frequency increases.

The reflected and incident power signals may be represented by reflection coefficients known as scattering or S parameters. The scattering parameters define energy or power of a network in terms of impedance and admittance. The scattering parameters include $S_{11}$ and $S_{22}$. $S_{11}$ represents the input reflection coefficient at a first port. $S_{22}$ represents the output reflection coefficient at a second port. $S_{11}$ and $S_{22}$ provide an indication of how much power is reflected. $S_{21}$ shows the isolation between two antennas within an antenna arrangement or antenna diversity system.

Measured return loss display 400 illustrates the scattering or S parameters of antenna arrangement 100 depicted in FIG. 1. Measured return loss display 400 illustrates measurements of the input reflection coefficient, output reflection coefficient, and reversed transmission coefficient at two different ports of the antenna arrangement.

The return loss of dual-antenna arrangement 100 is measured at two separate antenna ports. In the illustrative embodiment of FIG. 4, $S_{22}$ corresponds to the return loss analyzed and measured at feed port 2 104 of first antenna 102, as illustrated by signal trace 1, Trc1 410. $S_{11}$ corresponds to the return loss analyzed at feed port 1 112 of second antenna 110 as illustrated by signal trace 3, Trc3 430.

$S_{11}$, Trc3 430, and $S_{22}$, Trc1 410, measure the coupling and reflection of the second and first antenna, respectively. The value of the isolation is illustrated by $S_{21}$ trace 2, Trc2 420. Within the 700 band resonant frequency, the isolation may be optimum at a frequency of about 760 MHZ with an isolation of about −8 decibels (dB). An isolation value within a range of between 10 and 12 decibels is considered optimum for the 746 to 787 Megahertz frequency range.

Figure 5A:
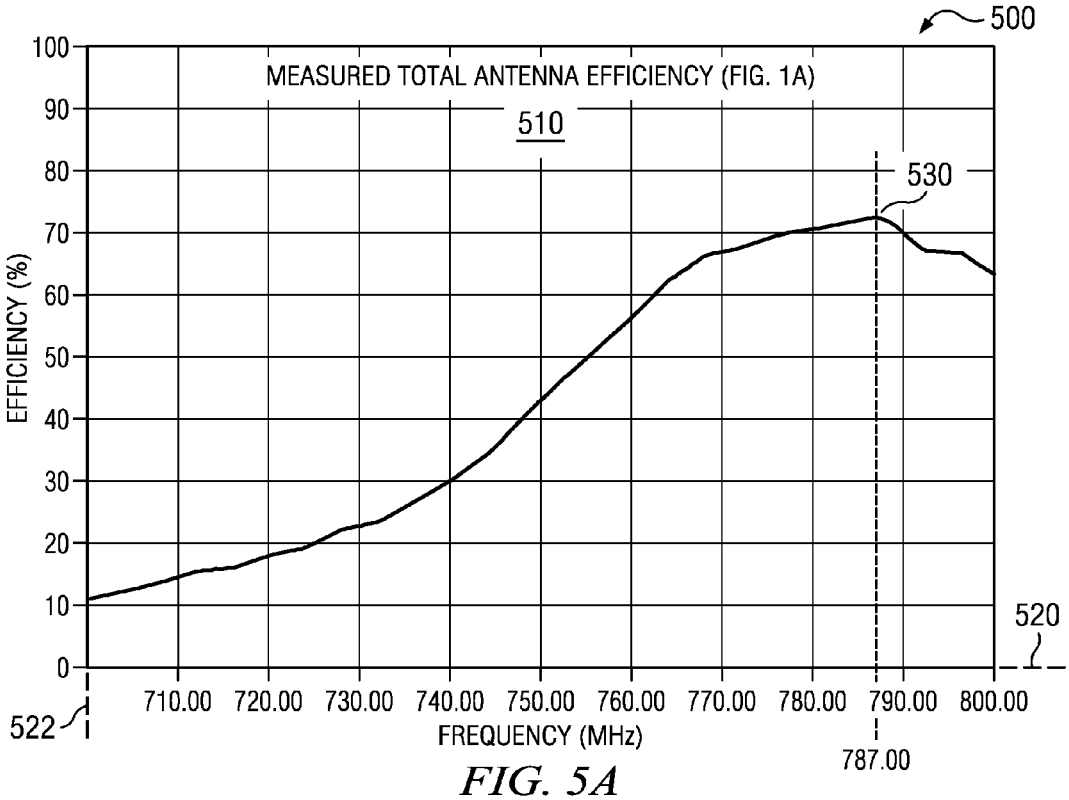
FIG. 5 illustrates displays of the measured antenna efficiency in FIG. 5A, FIGS. 5B and 5C at ports of the dual-antenna diversity arrangement illustrated in FIG. 1.
Figure 5B:
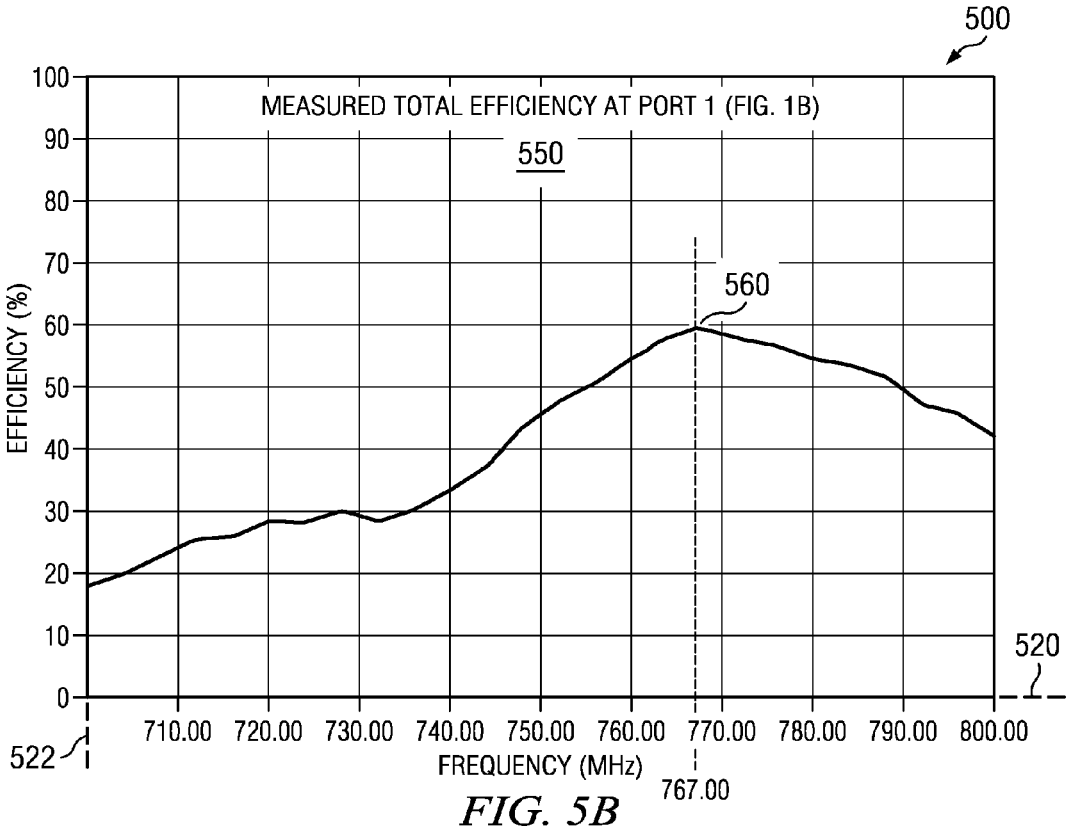

FIG. 5 illustrates displays of the measured antenna efficiency in FIG. 5A and FIG. 5B at ports of the dual-antenna diversity arrangement illustrated in FIG. 1, respectively.

Referring first to FIG. 5A, display 500 illustrates plot 510 of the antenna efficiency measured at port 2 104 of the dual-antenna diversity arrangement illustrated in FIG. 1. Plot 510 measures frequency in units of Megahertz (MHz) on the X-axis 520. On the Y-axis 522, a measurement of efficiency is illustrated. Efficiency is a measure of the percentage of power radiated to the total power accepted at a port of an antenna. In this illustrative embodiment, plot 510 illustrates the efficiency measured at port 2 104 of FIG. 1 of the dual-antenna diversity arrangement.

Within the range of any frequency band, it is optimum to have the power that is radiated to be as large as possible. In the illustrative embodiment of plot 510, the range of interest of operating frequencies is approximately 745 MHz to 787 MHz. The measured total antenna efficiency is achieved at approximately seventy percent (70%) efficiency 530 at around 787 MHz. It must be noted that plot 500 provides measurements based on an actual antenna system environment, instead of a simulated or free space environment.

Referring next to FIG. 5B, display 500, illustrates plot 550 of the antenna efficiency measured at port 1 112 of the dual-antenna diversity arrangement illustrated in FIG. 1. In the illustrative embodiment of plot 550, the frequency range of interest is around 745 MHz to 787 MHz. The measured total antenna efficiency is achieved at approximately sixty percent (60%) efficiency 560 at around 767 MHz.

Figure 5C:
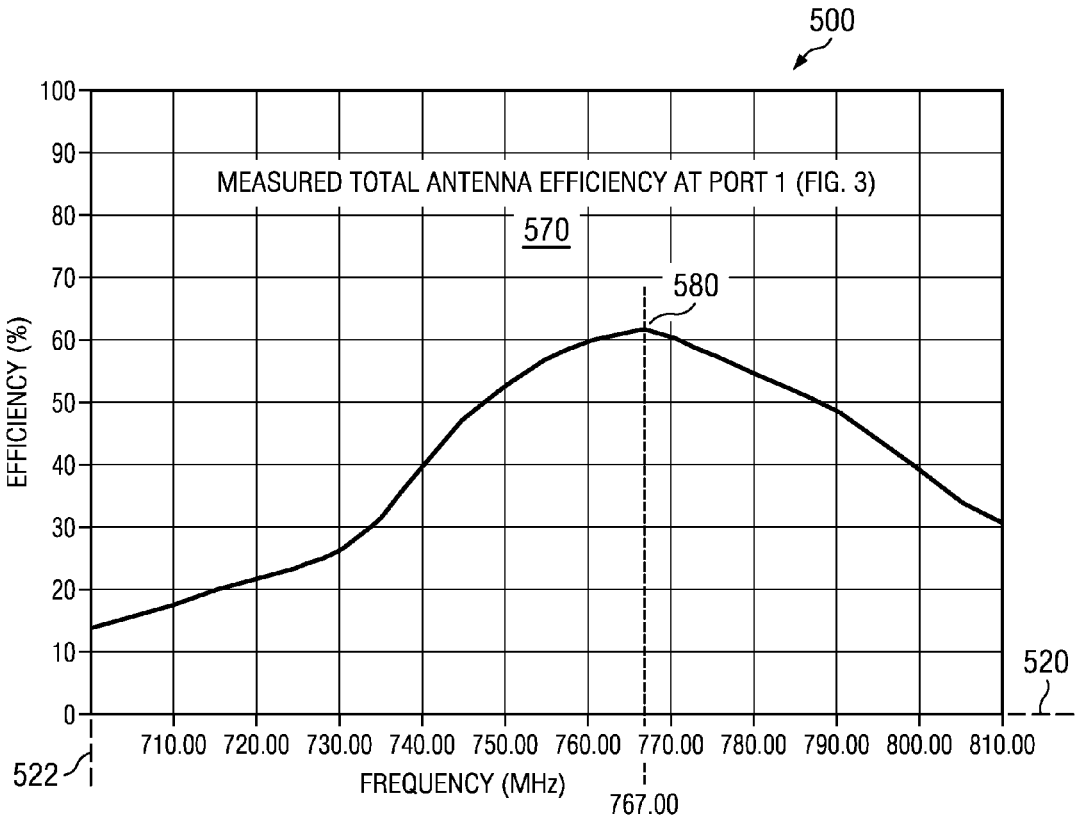

FIG. 5C, display 500, illustrates plot 570 of the antenna efficiency measured at port 1 212 of the dual-antenna diversity arrangement illustrated in FIG. 2. In the illustrative embodiment of plot 570, the frequency range of interest is around 745 MHz to 787 MHz. The measured total antenna efficiency is achieved at approximately sixty-two percent (62%) efficiency 580 at around 767 MHz.

Figure 6A:
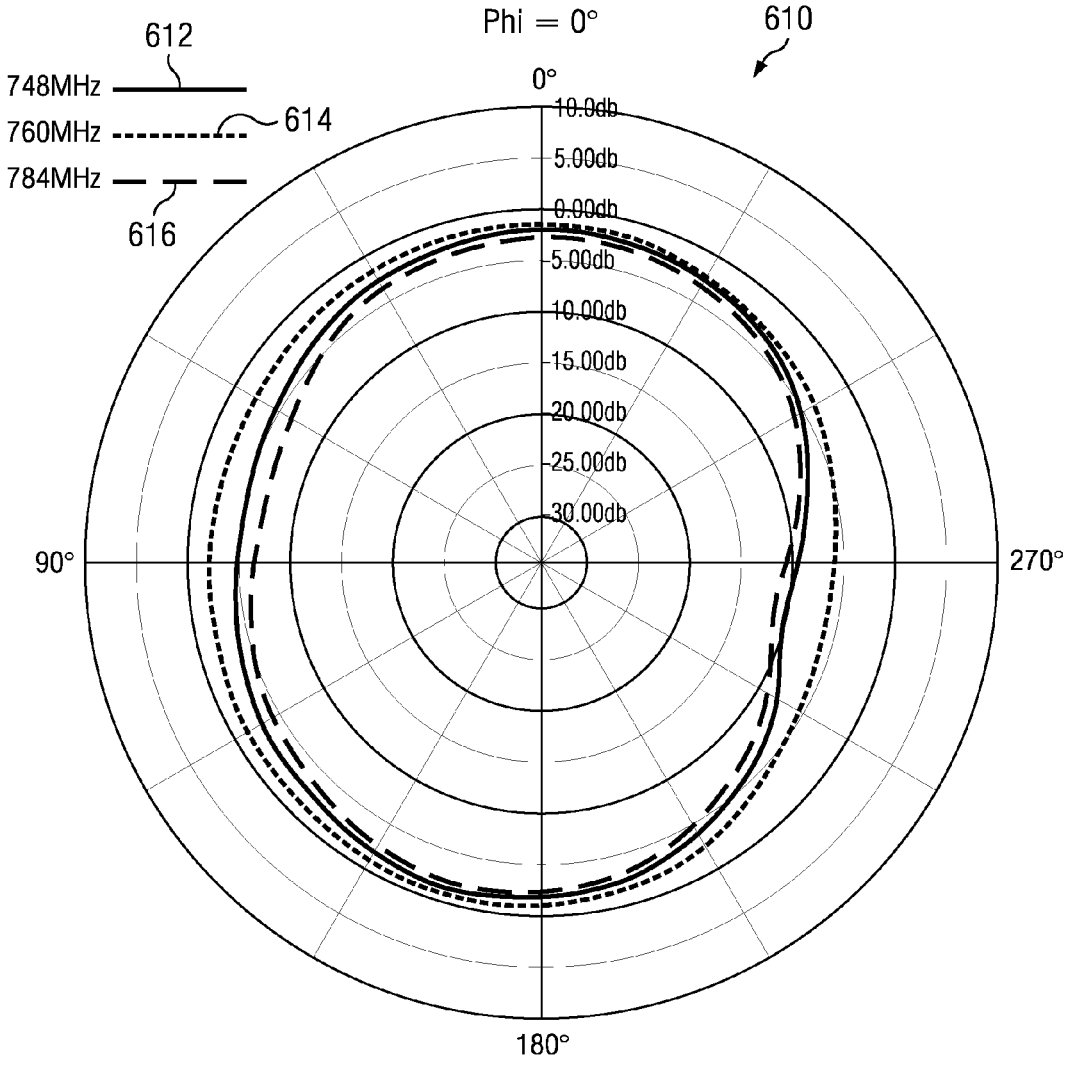
FIG. 6 illustrates polar plots in FIG. 6A, FIG. 6B, and FIG. 6C of the dual-antenna diversity arrangement illustrated in FIG. 1 at various selected frequencies of 748 MHz, 760 MHz, and 784 MHZ.
Figure 6B:
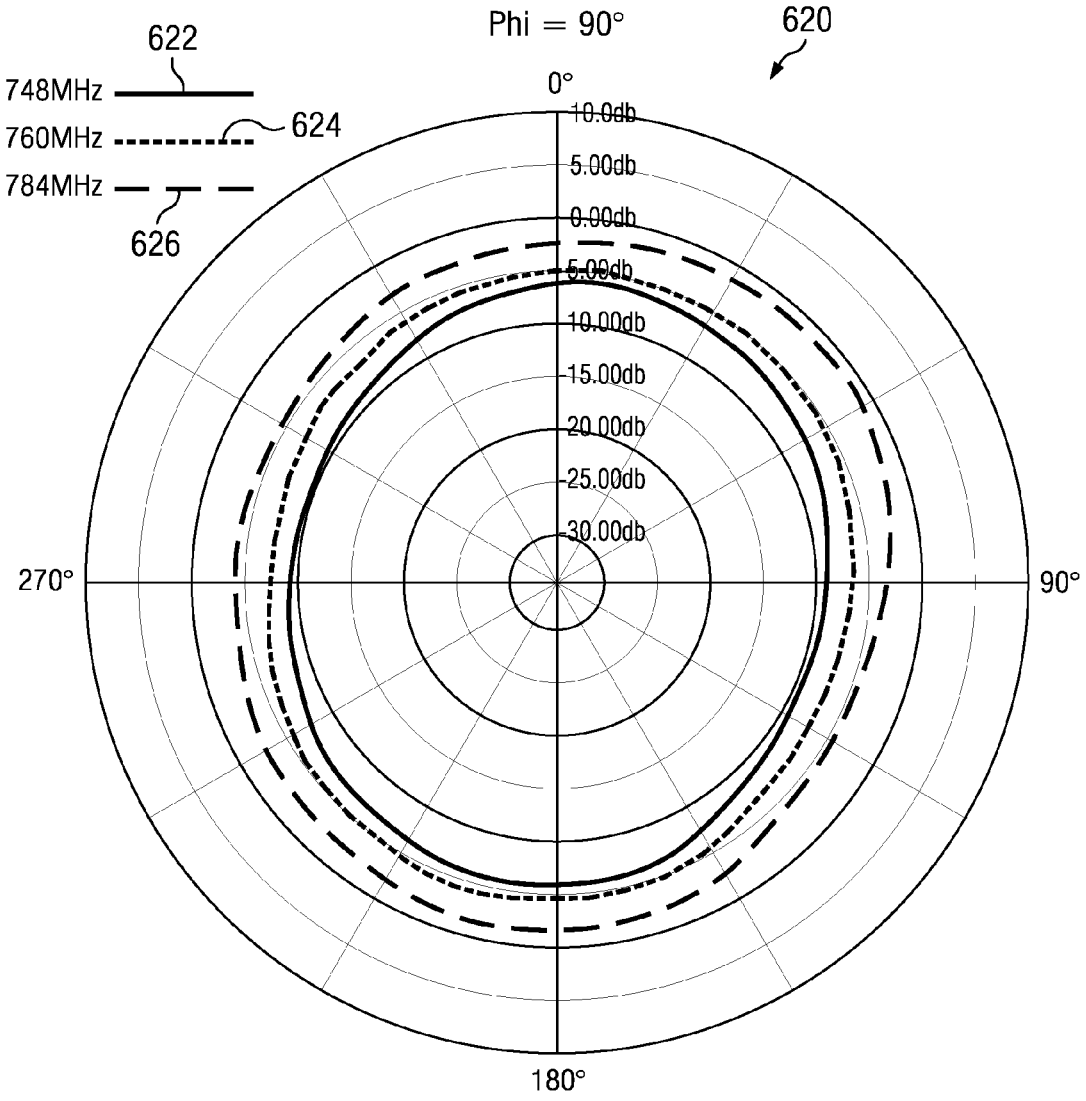
Figure 6C:
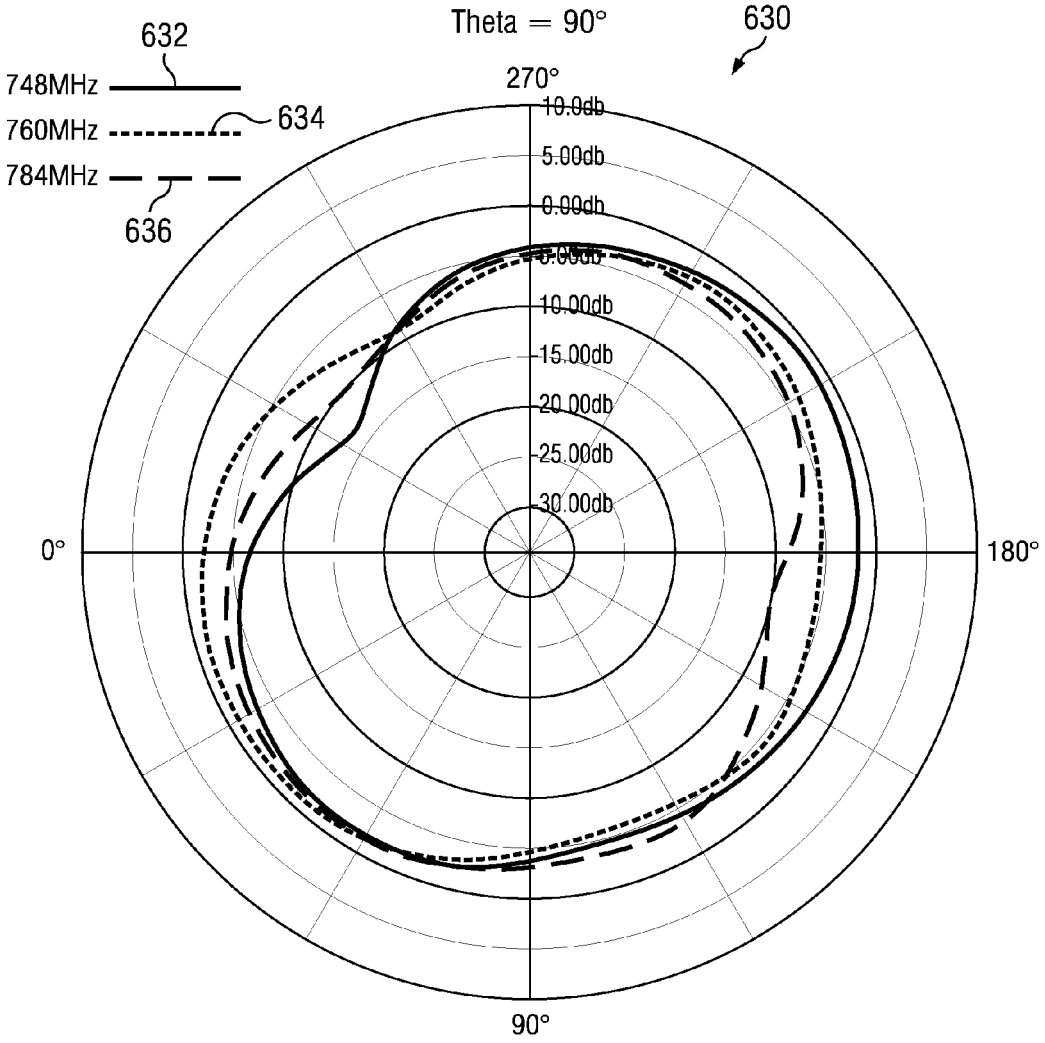

FIG. 6 illustrates two dimensional radiation patterns in polar plots of FIG. 6A, FIG. 6B, and FIG. 6C of the dual-antenna diversity arrangement illustrated in FIG. 1 at various selected frequencies of 748 MHz, 760 MHz, and 784 MHZ. FIG. 6A-FIG. 6C represent two dimensional radiation patterns in different planes at several different frequencies. In the 700 MHZ band, the radiation patterns are primarily omnidirectional.

Turning first to FIG. 6A, two dimensional polar plot 610 illustrates the far-field radiation pattern of first antenna 102 of the dual-antenna diversity arrangement 100 illustrated in FIG. 1 at three different operating frequencies and orientations of the antenna. Radiation pattern 612 represents the radiation pattern at a frequency of approximately 748 MHz in the azimuth plane of the axis of dual-antenna diversity arrangement 100 at an angle of phi=0°. Radiation pattern 614 represents the radiation pattern at a frequency of approximately 760 MHz. Radiation pattern 616 represents the radiation pattern at a frequency of approximately 784 MHz. Radiation pattern 614 illustrates an omnidirectional radiation pattern at about 760 MHz.

Turning next to FIG. 6B, two dimensional polar plot 620 illustrates the far-field radiation pattern of the dual-antenna diversity arrangement 100 illustrated in FIG. 1 at three different operating frequencies and orientations of the antenna. Radiation pattern 622 represents the radiation pattern at a frequency of approximately 748 MHz in the plane of the axis of dual-antenna diversity arrangement 100 at an angle of phi=90°. Radiation pattern 624 represents the radiation pattern at a low frequency of approximately 760 MHz. Radiation pattern 626 represents the radiation pattern at a frequency of approximately 784 MHz.

Turning next to FIG. 6C, two dimensional polar plot 630 illustrates the far-field radiation pattern of the dual-antenna diversity arrangement 100 illustrated in FIG. 1 at three different operating frequencies and orientations of the antenna. Radiation pattern 632 represents the radiation pattern at a frequency of approximately 748 MHz in a plane of the axis of dual-antenna diversity arrangement 100 at an angle of theta=90°. Radiation pattern 634 represents the radiation pattern at a low frequency of approximately 760 MHz. Radiation pattern 636 represents the radiation pattern at a frequency of approximately 784 MHz.

Figure 7:
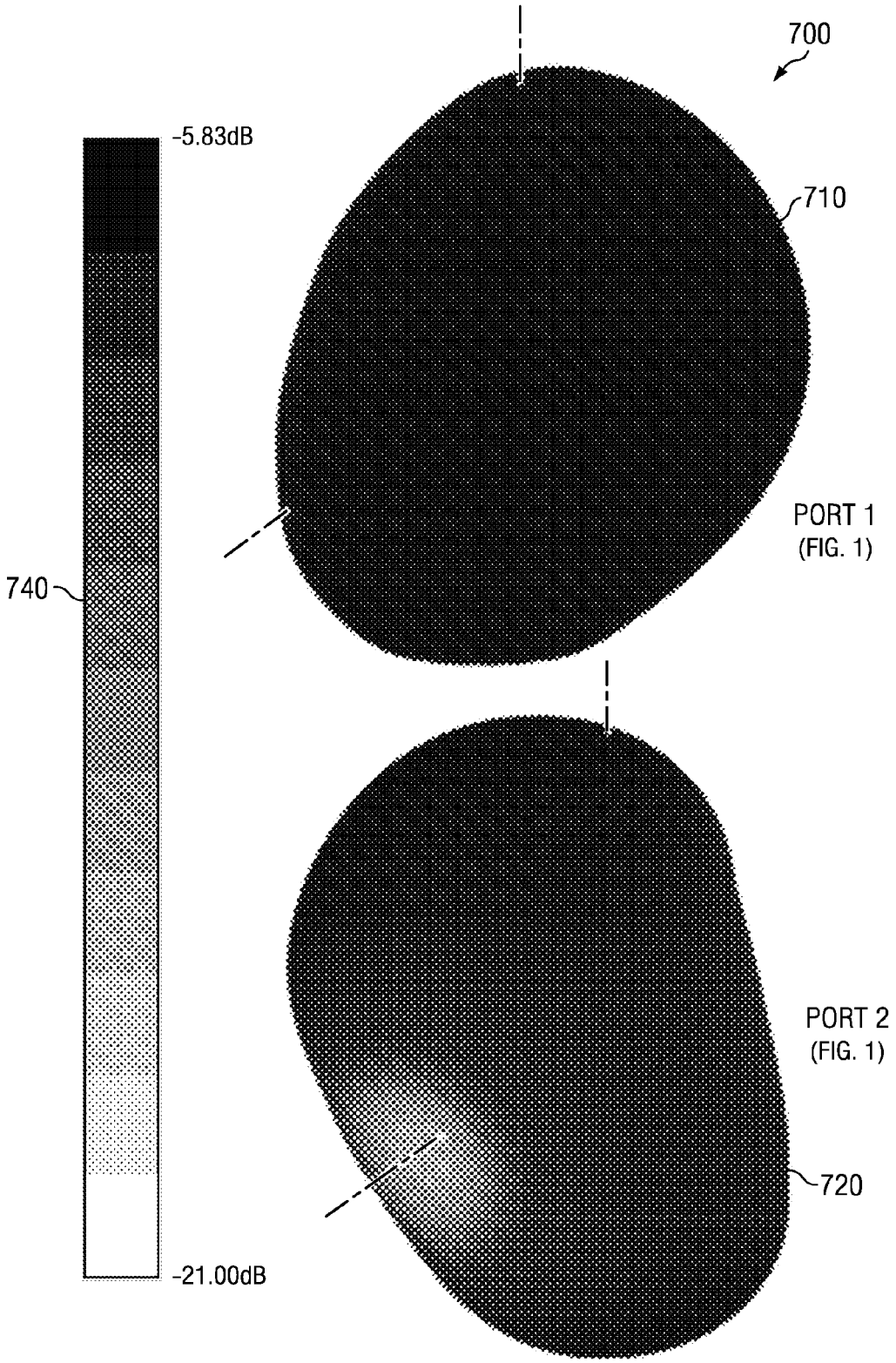
FIG. 7 illustrates three-dimensional views of the measured radiation pattern from ports of the dual-antenna diversity arrangement illustrated in FIG. 1 at a frequency of about 760 MHz according to an illustrative embodiment of the disclosure.

Turning now to FIG. 7, a three-dimensional view of a normalized radiation pattern 700 measured from feed port 1 112 and feed port 2 104 of dual-antenna diversity arrangement 100 of FIG. 1 is depicted according to an illustrative embodiment of the disclosure. In the illustrative embodiment, normalized radiation pattern 700 is illustrated by a port 1 view 710 as measured from feed port 2 104 of first antenna 102 and a port 2 view 720 as measured from feed port 1 112 of second antenna 110 as illustrated in FIG. 1. It must be noted that radiation pattern 700 provides measurements based on an actual antenna system environment, and not based on a simulated or free space environment.

Radiation pattern 700 illustrates a three dimensional view of the minimum and maximum radiated power or gain measured at a far-field distance from the antenna. The minimum far-field distance is required to be at least about $2D^2/\lambda$, where D is the largest dimension of the antenna and $\lambda$ is the wavelength of the frequency. In this illustrative embodiment, the port 1 710 pattern and the port 2 720 pattern illustrates a dipole radiation pattern that shows a relative distribution of radiation power in a range 740 that spans from −21.00 dB to −5.83 dB.

Port 1 710 pattern and port 2 720 pattern illustrates radiation patterns that are directional. Directional radiation patterns radiate signals of high power or gain in a specific direction. In this embodiment, the maximum radiated power, as illustrated by radiation legend 740, is about −21 dB. The directional radiation patterns of port 1 710 and port 2 720 exemplify or illustrate pattern diversity as the radiation pattern of port 1 710 differs from the radiation pattern of port 2 720.

Figure 8:
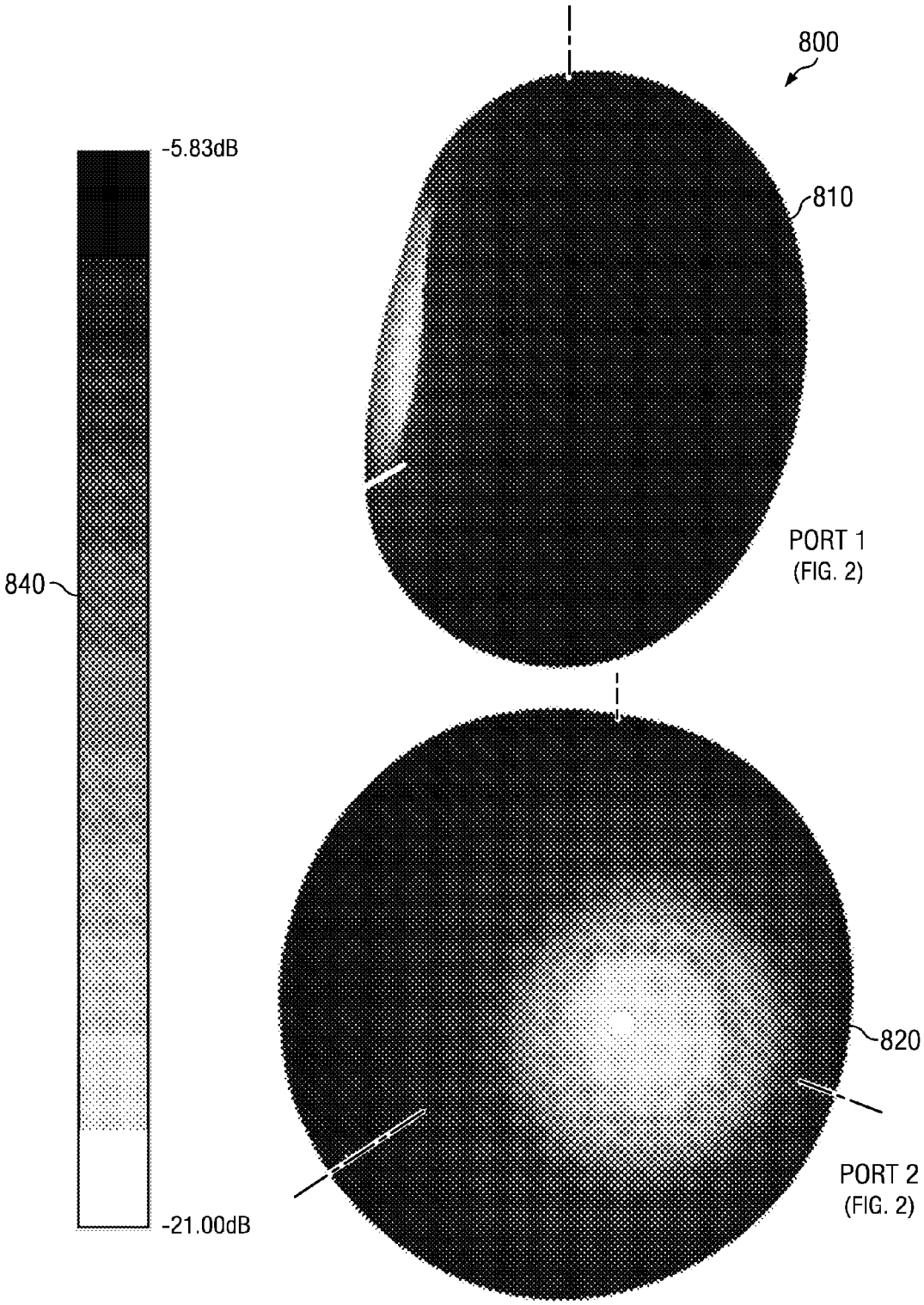
FIG. 8 illustrates a three-dimensional view of the measured radiation pattern from ports on the dual-antenna diversity arrangement illustrated in FIG. 2 at a frequency of about 760 MHz according to an embodiment of the disclosure.

FIG. 8 illustrates a three-dimensional view of the measured radiation pattern from ports on the dual-antenna diversity arrangement illustrated in FIG. 2 at a frequency of about 760 MHz according to an embodiment of the disclosure.

In the illustrative embodiment, normalized radiation pattern 800 is illustrated by a port 1 view 810 as measured from feed port 2 204 of first antenna 202 and a port 2 view 820 as measured from feed port 1 212 of second antenna 210 as illustrated in FIG. 2. It must be noted that radiation pattern 800 provides measurements based on an actual antenna system environment, and not based on a simulated or free space environment.

Port 1 810 pattern and port 2 820 pattern illustrates radiation patterns that are directional. Directional radiation patterns radiate signals of high power or gain in a specific direction. In this embodiment, the maximum radiated power, as illustrated by radiation legend 840, is about −21 dB. The directional radiation patterns of port 1 810 and port 2 820 exemplify or illustrate pattern diversity as the radiation pattern of port 1 810 differs from the radiation pattern of port 2 820.

Figure 9:
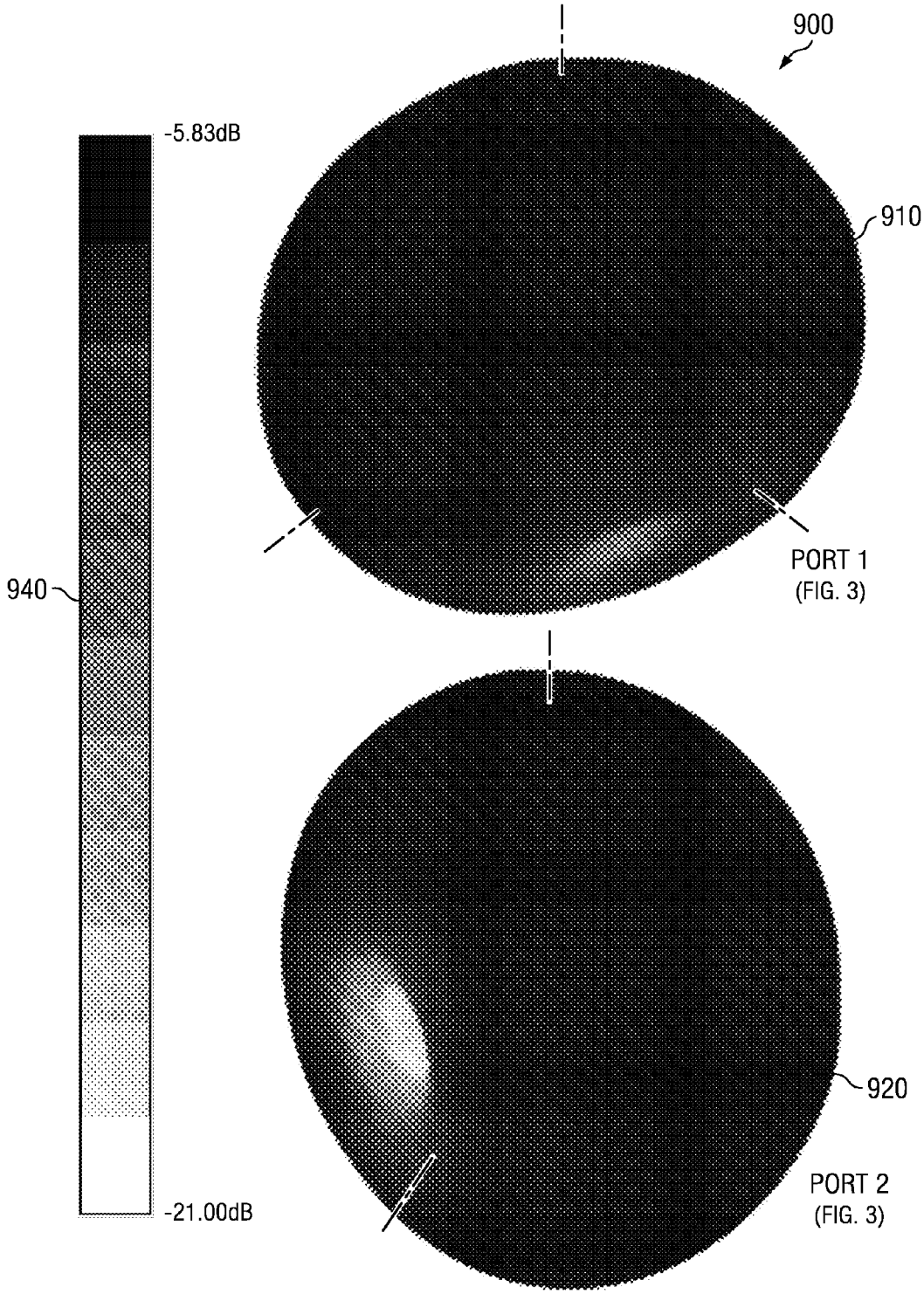
FIG. 9 illustrates a three-dimensional view of the measured radiation pattern from ports on the dual-antenna diversity arrangement illustrated in FIG. 3 at a frequency of about 760 MHz according to an embodiment of the disclosure.

FIG. 9 illustrates a three-dimensional view of the measured radiation pattern from ports on the dual-antenna diversity arrangement illustrated in FIG. 3 at a frequency of about 760 MHz according to an embodiment of the disclosure.

In the illustrative embodiment, normalized radiation pattern 900 is illustrated by a port 1 view 910 as measured from feed port 2 304 of first antenna 302 and a port 2 view 920 as measured from feed port 1 312 of second antenna 310 as illustrated in FIG. 3. It must be noted that radiation pattern 900 provides measurements based on an actual antenna system environment, and not based on a simulated or free space environment.

Port 1 910 pattern and port 2 920 pattern illustrates radiation patterns that are directional. Directional radiation patterns radiate the most or the greatest power in a specific direction. In this embodiment, the maximum radiated power, as illustrated by radiation legend 940, is about −21 dB. The directional radiation patterns of port 1 910 and port 2 920 exemplify or illustrate pattern diversity as the radiation pattern of port 1 910 differs from the radiation pattern of port 2 920.

Figure 10:
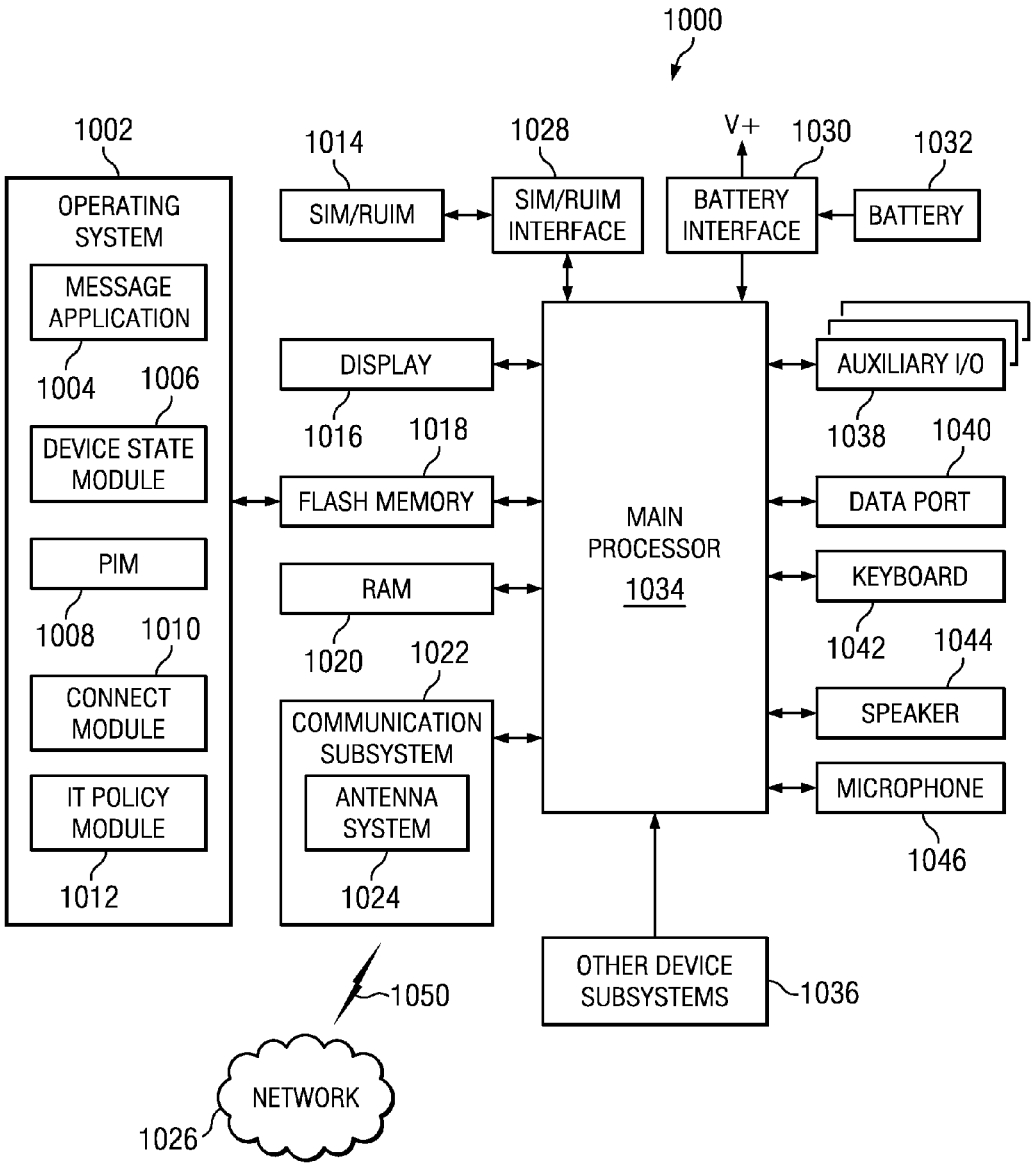
FIG. 10 illustrates a block diagram of an exemplary mobile terminal that may be used to implement illustrative embodiments of the disclosure.

Referring now to FIG. 10, a block diagram of mobile communication device 1000 is illustrated according to an illustrative embodiment of the disclosure. Mobile communication device 1000 may be a mobile wireless communication device, such as a mobile cellular device, herein referred to as a mobile device that may function as a Smartphone, which may be configured according to an information technology (IT) policy. Mobile communication device 1000 may be configured to an antenna arrangement such as dual-antenna diversity arrangement 100 depicted in FIG. 1.

Mobile communication device 1000 includes communication elements in communication subsystem 1022 that may be configured to operate with a dual-antenna diversity arrangement such as the arrangement of FIG. 1B. Antenna system 1024 may be configured to support multiple input multiple output technology. Antenna system 1024 may include a plurality of antennas for simultaneous or individual radio frequency signal transmissions.

The term information technology, in general, refers to a collection of information technology rules, in which the information technology policy rules may be defined as being either grouped or non-grouped and global or per user. The terms grouped, non-grouped, global, and per-user are defined further below. Examples of applicable communication devices include pagers, mobile cellular phones, cellular smart-phones, wireless organizers, personal digital assistants, computers, laptops, handheld wireless communication devices, wirelessly enabled notebook computers and such other communication devices.

The mobile device is a two-way communication device with advanced data communication capabilities including the capability to communicate with other mobile devices, computer systems, and assistants through a network of transceivers. In FIG. 10, the mobile device includes a number of components such as main processor 1034 that controls the overall operation of user equipment 1000. Communication functions are performed through communication subsystem 1022. Communication subsystem 1022 receives messages from and sends messages across wireless link 1050 to wireless communications network 1026.

Communications subsystem 1022 provides for communication between the mobile device 1000 and different systems or devices such as antenna system 1024, without the use of the wireless communications network 1026. For example, communications subsystem 1022 may include an infrared device and associated circuits and components for short-range communication. Examples of short-range communication standards include standards developed by the Infrared Data Association (IrDA), Bluetooth, and the 802.11 family of standards developed by the Institute of Electrical and Electronics Engineers (IEEE). Short range communications may include, for example, without limitation, radio frequency signals within a 2.4 GHz band or a 5.8 GHz band.

In this illustrative embodiment of the mobile device, the communication subsystem 1022 is configured in accordance with the Global System for Mobile Communication (GSM) and General Packet Radio Services (GPRS) standards. The GSM/GPRS wireless communications network is used worldwide and it is expected that these standards will be superseded eventually by, for example, without limitation, Evolved Enhanced Data GSM Environment (EEDGE), Universal Mobile Telecommunications Service (UMTS), High Speed Packet Access (HSPA), Long Term Evolution (LTE), and other standards applicable to multiple input multiple output technology. New standards are still being defined, but it is believed that they will have similarities to the network behavior described herein, and it will also be understood by persons skilled in the art, that the embodiments described herein are intended to use any other suitable standards that are developed in the future.

The wireless link 1050 connecting the communication subsystem with wireless communications network 1026 represents one or more different radio frequency (RF) channels, operating according to defined protocols specified for GSM/GPRS communications. With newer network protocols, these channels are capable of supporting both circuit switched voice communications and packet switched data communications. Antenna arrangements, such as antenna arrangement 204 of FIG. 2, are implemented by antenna system 1024 of communication subsystem 1022. Antenna arrangement 204 is implemented between network 1026 and main processor 1034 and enables the mobile communication device to have a higher data rate and a higher throughput based on high correlation and isolation.

Although the wireless communications network 1026 associated with mobile device 1000 may be a GSM/GPRS/EDGE wireless communications network in one illustrative implementation, other wireless communications networks may also be associated with the mobile device 1000 in variant implementations. Examples of these networks include, but are not limited to, Code Division Multiple Access (CDMA) or CDMA2000 networks, GSM/GPRS/EDGE networks (as mentioned above), third-generation (3G) networks such as UMTS and HSPA, and also future fourth-generation (4G) networks such as LTE and Worldwide Interoperability for Microwave Access (WiMax).

The main processor 1034 also interacts with additional subsystems such as Random Access Memory (RAM) 1020, a flash memory 1018, a display 1016, an auxiliary input/output (I/)O) 1038 subsystem, a data port 1040, a keyboard 1042, a speaker 1044, a microphone 1046, and other device subsystems 1036.

Some of the subsystems of the mobile device 1000 perform communication-related functions, whereas other subsystems may provide "resident" or on-device functions. By way of example, the display 1016 and the keyboard 1042 may be used for both communication-related functions, such as entering a text message for transmission over the network 1026, and device-resident functions such as a calculator or task list.

The mobile device 1000 can send and receive communication signals over the wireless communications network 1026 after required network registration or activation procedures have been completed. Network access is associated with a subscriber or user of the mobile device 1000. To identify a subscriber, the mobile device 1000 requires a Subscriber Identity Module or a Removable User Identity Module, SIM/RUIM module 1014, to be inserted into a SIM/RUIM interface 1028 in order to communicate with a network. The SIM/RUIM module 1014 is one type of a conventional "smart card" that can be used to identify a subscriber of the mobile device 1000 and to personalize the mobile device 1000, among other things. Without the SIM/RUIM module 1014, the mobile device 1000 is not fully operational for communication with the wireless communications network 1026.

By inserting the SIM/RUIM module 1014 into the SIM/RUIM interface 1028, a subscriber can access all subscribed services. Services may include: web browsing and messaging such as e-mail, voice mail, Short Message Service (SMS), and Multimedia Messaging Services (MMS). More advanced services may include: point of sale, field service and sales force automation. The SIM/RUIM module 1014 includes a processor and memory for storing information. Once the SIM/RUIM module 1014 is inserted into the SIM/RUIM interface 1028, it is coupled to the main processor 1034. In order to identify the subscriber, the SIM/RUIM module 1014 can include some user parameters such as an International Mobile Subscriber Identity (IMSI).

An advantage of using the SIM/RUIM module 1014 is that a subscriber is not necessarily bound by any single physical mobile device. The SIM/RUIM module 1014 may store additional subscriber information for a mobile device as well, including datebook (or calendar) information and recent call information. Alternatively, user identification information can also be programmed into the flash memory 1018. The mobile device 1000 is a battery-powered device and includes a battery interface 1030 for receiving one or more rechargeable batteries 1032. In at least some embodiments, the battery 1032 can be a smart battery with an embedded microprocessor. The battery interface 1030 is coupled to a regulator (not shown), which assists the battery 1032 in providing power V+ to the mobile device 1000. Although current technology makes use of a battery, future technologies such as micro fuel cells may provide the power to the mobile device 1000.

The mobile device 1000 also includes an operating system 1002 and software components 1004 to 1012 which are described in more detail below. The operating system 1002 and the software components 1004 to 1012 that are executed by the main processor 1034 are typically stored in a persistent store such as the flash memory 1018, which may alternatively be a read-only memory (ROM) or similar storage element (not shown). Those skilled in the art will appreciate that portions of the operating system 1034 and the software components 1004 to 1012, such as specific device applications, or parts thereof, may be temporarily loaded into a volatile store such as the RAM 1020. Other software components can also be included, as is well known to those skilled in the art.

The subset of software applications 1036 that control basic device operations, including data, voice communication applications, antenna system 1024, and communication subsystem 1022 applications will normally be installed on the mobile device 1000 during its manufacture. Other software applications include a message application 1004 that can be any suitable software program that allows a user of the mobile device 1000 to send and receive electronic messages.

The software applications can further include a device state module 1006, a Personal Information Manager (PIM) 1008 and other suitable modules (not shown). The device state module 1006 provides persistence which means that the device state module 1006 ensures that important device data is stored in persistent memory, such as the flash memory 1018, so that the data is not lost when the mobile device 1000 is turned off or loses power.

The PIM 1008 includes functionality for organizing and managing data items of interest to the user, such as, but not limited to, e-mail, contacts, calendar events, voice mails, appointments, and task items. A PIM application has the ability to send and receive data items via the wireless communications network 1026.

The mobile device 1000 also includes a connect module 1010, and an information technology (IT) policy module 1012. The connect module 1010 implements the communication protocols that are required for the mobile device 1000 to communicate with the wireless infrastructure and any host system, such as an enterprise system, with which the mobile device 1000 is authorized to interface.

The connect module 1010 includes a set of application programming interfaces (APIs) that can be integrated with the mobile device 1000 to allow the mobile device 1000 to use any number of services associated with the enterprise system. The connect module 1010 allows the mobile device 1000 to establish an end-to-end secure, authenticated communication pipe with the host system. A subset of applications for which access is provided by the connect module 1010 can be used to pass IT policy commands from the host system to the mobile device 1000. This can be done in a wireless or wired manner.

The IT policy module 1012 receives IT policy data that encodes the IT policy. The IT policy module 1012 then ensures that the IT policy data is authenticated by the mobile device 1000. The IT policy data can then be stored in the flash memory 1018 in its native form. After the IT policy data is stored, a global notification can be sent by the IT policy module 1012 to all of the applications residing on the mobile device 1000. Applications for which the IT policy may be applicable then respond by reading the IT policy data to look for IT policy rules that are applicable.

Other types of software applications can also be installed on the mobile device 1000. These software applications can be third party applications, which are added after the manufacture of the mobile device 1000. Examples of third party applications include games, calculators, utilities, and other similar applications know to one skilled in the art.

The additional applications can be loaded onto the mobile device 1000 through the wireless communications network 1026, the auxiliary I/O 1038 subsystem, the data port 1040, the communication subsystem 1022, or any other suitable device subsystem 1036. This flexibility in application installation increases the functionality of the mobile device 1000 and may provide enhanced on-device functions, communication-related functions, or both.

The data port 1040 enables a subscriber to set preferences through an external device or software application and extends the capabilities of the mobile device 1000 by providing for information or software downloads to the mobile device 1000 other than through a wireless communication network. The alternate download path may, for example, be used to load an encryption key onto the mobile device 1000 through a direct and thus reliable and trusted connection to provide secure device communication.

The data port 1040 may be any suitable port that enables data communication between the mobile device 1000 and another computing device. The data port 1040 may be a serial or a parallel port. In some instances, the data port 1040 may be a USB port that includes data lines for data transfer and a supply line that can provide a charging current to charge the battery 1032 of the mobile device 1000.

In operation, a received signal such as a text message, an e-mail message, or web page download will be processed by the communication subsystem 1022 and input to the main processor 1034. The main processor 1034 will then process the received signal for output to the display 1016 or alternatively to the auxiliary I/O subsystem 1038. A subscriber may also compose data items, such as e-mail messages, for example, using the keyboard 1042 in conjunction with the display 1016 and possibly the auxiliary I/O subsystem 1038. The auxiliary I/O subsystem 1038 may include devices such as: a touch screen, mouse, track ball, infrared fingerprint detector, or a roller wheel with dynamic button pressing capability. The keyboard 1042 is preferably an alphanumeric keyboard together with or without a telephone-type keypad. However, other types of keyboards may also be used. A composed data item may be transmitted over the wireless communications network 1026 through the communication subsystem 1022.

For voice communications, the overall operation of the mobile device 1000 is substantially similar, except that the received signals are output to the speaker 1044, and signals for transmission are generated by the microphone 1046. Alternative voice or audio I/O subsystems, such as a voice message recording subsystem, can also be implemented on the mobile device 1000. Although voice or audio signal output is accomplished primarily through the speaker 1044, the display 1016 can also be used to provide additional information such as the identity of a calling party, duration of a voice call, or other voice call related information.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein.

The embodiment or embodiments selected are chosen and described in order to best explain the principles of the embodiments, the practical application, and to enable others of ordinary skill in the art to understand the disclosure for various embodiments with various modifications as are suited to the particular use contemplated. For example, the various elements or components may be combined or integrated in another system or certain features may be omitted or not implemented.

Also, techniques, systems, and subsystems, and described and illustrated in the various embodiments as discrete or separate may be combined or integrated with other systems, modules, or techniques without departing from the scope of the present disclosure. Other items shown or discussed as coupled or directly coupled or communicating with each other may be indirectly coupled or communicated through some other interface, device or intermediate component whether electrically, mechanically, or otherwise. Other examples of changes, substitutions, and alterations are ascertainable by one skilled in the art and could be made without departing from the spirit and scope disclosed herein.

What is claimed is:

1. A mobile communications device comprising:

a single three-dimensional dielectric substrate;

dual-three dimensional antennas, each antenna of the dual-three dimensional antennas comprising a plurality of conductive strip segments electrically connected together and folded in a three dimensional meander pattern onto the substrate;

wherein a first antenna of said dual-antennas is disposed at a first corner of the dielectric substrate and comprises a first feed port and a first ground pin;

wherein a second antenna of said dual-antennas is disposed at a second corner of said dielectric substrate that is opposite the first corner and comprises a second feed port and a second ground pin; and wherein said second antenna is configured in a meander pattern that is the same as said first antenna.

2. The mobile communications device of claim 1, wherein said first antenna and said second antenna are oriented at a ninety degree angle with respect to each other.

3. The mobile communications device of claim 1, wherein said first antenna and said second antenna are arranged in a balanced configuration with respect to each other.

4. The mobile communications device of claim 3, wherein said first antenna and said second antenna are disposed onto said three-dimensional dielectric substrate in a mirror symmetry arrangement with respect to each other.

5. The mobile communications device of claim 1, wherein said first antenna comprises said first feed port and said first ground pin; and said second antenna comprises said second feed port and said second ground pin.

6. The mobile communications device of claim 1, wherein each antenna is one of a planar inverted F antenna and an inverted F antenna.

7. The mobile communications device of claim 1, wherein said first antenna is operational as a transceiver and said second antenna is operational as a receiver.

8. The mobile communications device of claim 1, wherein a distance between said first antenna and said second antenna is at least 30 millimeters.

9. The mobile communications device of claim 1, further comprising: a housing; and a ground plane opposite to the plane of said three-dimensional dielectric substrate.

10. The mobile communications device of claim 1, wherein said three-dimensional dielectric substrate is polygonal in configuration.

11. The mobile communications device of claim 1, wherein said dual-antennas radiate at a same time within a range of frequencies in a 700 Megahertz frequency band.

12. An antenna arrangement for a mobile communication device, comprising:

a single three-dimensional dielectric substrate;

dual three-dimensional-antennas, each antenna comprising a plurality of conductive strip segments electrically connected together and folded in a three dimensional meander pattern onto the substrate, wherein a first antenna of said dual-antennas is disposed at a first corner of the dielectric substrate;

wherein a second antenna of said dual-antennas includes conductive strip segments folded in said three dimensional meander pattern that is identical to said first antenna and is disposed at a second corner of the dielectric substrate that is opposite the first corner; and wherein said first antenna and said second antenna comprises a separate feed port and a separate ground pin.

13. The antenna arrangement of claim 12, wherein said first antenna and said second antenna are disposed onto said dielectric substrate with mirror symmetry with respect to each other.

14. The antenna arrangement of claim 12, wherein said first antenna and said second antenna are oriented at a ninety degree angle with respect to each other.

15. The antenna arrangement of claim 12, wherein said three-dimensional dielectric substrate is polygonal in configuration.

16. The antenna arrangement of claim 12, wherein said dual-antennas radiate at a same time within a range of frequencies in a 700 Megahertz frequency band.

17. A mobile communications device comprising:

a housing;

a single three-dimensional dielectric substrate mounted in the housing, the substrate including a first part and a second part that is opposite the first part;

a first, three-dimensional antenna disposed at the first part of substrate, the first antenna comprising a plurality of first conductive strip segments electrically connected together and folded in a first, three-dimensional meander pattern on the substrate, a first feed port, and a first ground pin;

a second, three-dimensional antenna disposed at the second part of substrate, the second antenna comprising a plurality of second conductive strip segments electrically connected together a folded in a second, three-dimensional meander pattern on the substrate, a second feed port, and a second ground pin; and wherein said second meander pattern is the same as said first meander pattern.

* * * * *